US005785159A

United States Patent [19]

Jackson et al.

[11] Patent Number: 5,785,159

[45] Date of Patent: Jul. 28, 1998

[54] BRAKING MECHANISM FOR RAILROAD CARS HAVING BOTH PNEUMATIC AND MECHANICAL ACTUATORS

[75] Inventors: Robert G. Jackson, St. Joseph, Mich.; Leonard F. Manyek, Lansing, Ill.

[73] Assignee: Triax-Davis, Inc., Benton Harbor, Mich.

[21] Appl. No.: 659,230

[22] Filed: Jun. 5, 1996

[51] Int. Cl.[6] ..... B61H 13/02

[52] U.S. Cl. ..... 188/219.1; 188/207; 188/213

[58] Field of Search ..... 188/207, 212, 188/213, 219.6, 226.1, 228.6, 229.6, 233.7, 233.3

[56] References Cited

U.S. PATENT DOCUMENTS 2,375,727 5/1945 Buckwalter ..... 188/213

4,312,428 1/1982 Beacon ..... 188/219.1

5,259,485 11/1993 Jackson ..... 188/207

5,361,876 11/1994 Haverick et al. ..... 188/219.1

*Primary Examiner*—Matthew C. Graham

*Attorney, Agent, or Firm*—Baker & Daniels

[57] ABSTRACT

A braking mechanism according to the present invention for braking the wheels of a wheeled truck assembly includes a handle mounted to one beam which, when braking force is applied, urges a rod toward the other beam. The rod operates a lever mounted to the other beam which engages the actuation rod of the vehicle's pneumatic braking system, thereby operating the linkage included in the pneumatic system to separate the beams, bringing the brake pads into contact with the wheels to brake the wheels.

12 Claims, 6 Drawing Sheets

BRAKING MECHANISM FOR RAILROAD CARS HAVING BOTH PNEUMATIC AND MECHANICAL ACTUATORS

FIELD OF THE INVENTION

This invention relates to a braking mechanism for braking the wheels of a railroad car.

DESCRIPTION OF THE RELATED ART

Railroad car trucks are typically equipped with a pneumatically activated braking system having two brake beams mounted near the truck wheels. The beams have extensions which fit into slots or pockets formed into the truck sidewalls. A linkage extends between the beams and, when actuated, an air cylinder extends the linkage causing the beams to separate. Ideally, the extensions of each beam slide simultaneously within the sidewall pockets as the beams separate. Brake shoes located on the ends of the beams then contact the wheels, stopping the car.

When a railroad car is separated from the train's air supply, such as during loading or unloading or for storage, the pneumatic brakes cannot function. Separated cars can roll if the railroad tracks are inclined or if external forces are applied to the cars. Heretofore, separated cars have employed mechanically actuated braking mechanisms to lock the wheels of cars at rest which use rigging to separate the brake beams without using the pneumatically activated linkage. This rigging consists of an under rod and lever system in which the under rod extends perpendicularly between the two brake beams and is connected at each end to a lever mounted near the end of a beam. Both levers, (that is, the force application lever and the reaction lever), are pivotally attached to a respective beam at the lever fulcrum, the lower ends of the levers being connected together by the under rod. The other end of the force application lever is connected by a chain to a wheel and gear mechanism which the train operator turns to activate the brakes. The other end of the reaction lever is connected to the car frame as a reaction force support. When the wheel is turned, the chain pulls the activation lever which pivots, pushing the under rod toward the reaction lever. Since the other end of the reaction lever is attached to the car, the pushing of the under rod toward the lower end of the reaction lever causes the beams to separate.

Since the braking force is applied at the levers which are mounted offset from the center of the beams in the prior art devices, significantly greater braking force is applied to the brake shoes on the levering ends of the beams than is applied to the shoes on the other ends of the beams. This uneven braking force causes more rapid brake pad wear at the levering ends than would occur if the braking force was more evenly distributed among all four brake pads. The more rapidly the pads wear, the more frequently they must be replaced at a substantial cost. These repairs also increase the percentage of time that the car is non-operational, adding opportunity costs to the overall expense of the repairs. Secondly, the braking force translated to the far ends of the beams in prior art devices is insufficient to ensure that the beams maintain a parallel relationship as the beams separate. When the beams become misaligned during movement into a braking position, the beam extensions can become wedged at an angle within the sidewall pockets. In some instances, this "lock-up" condition renders the brakes ineffective because the brake pads are unable to contact the wheels. Conversely, the brakes can become locked in a braking position and incur damage when the car is moved during operation. In either case, the "lock-up" due to misalignment can remain or even be made worse when the operator later attempts to actuate the pneumatic braking system.

SUMMARY OF THE INVENTION

In this invention, the mechanically actuated braking mechanism cooperates with the linkage of the disconnected pneumatically actuated braking system to force the brake shoes against the car wheels with more evenly balanced braking force than possible using the prior art manual mechanisms. The braking force is applied to the mechanism through the chain from the wheel and gear mechanism as with conventional mechanisms. The chain pulls a handle lever mounted near the end of one beam. The other end of the handle lever is connected to a push rod which extends at an angle to an activation lever connected to the other beam.

When braking force is applied to the handle lever, it pivots, forcing the push rod toward the actuation lever which also pivots. As the actuation lever pivots, ridges carried by the lever engage the actuation rod of the pneumatic linkage. The actuation rod operates the centrally mounted pneumatic linkage, separating the beams while maintaining a substantially parallel relationship between the beams to force the brake pads against the car wheels with substantially equal force.

Accordingly, it is an object of the present invention to provide a novel and improved mechanically activated braking mechanism for braking the wheels of railroad cars.

Another object of the invention is to provide a braking mechanism which applies substantially balanced braking force to each of the car wheels.

Yet another object of the present invention is to provide a braking mechanism which moves the brake beams into a braking position while maintaining the parallel relationship of the beams, thereby ensuring that the beam extensions do not become wedged at an angle within the sidewall pockets.

Other objects of this invention will become apparent upon a reading of the following description.

BRIEF DESCRIPTION OF THE DRAWINGS

The above-mentioned and other objects and advantages of this invention, and the manner of attaining them, will become more apparent and the invention will be better understood by reference to the following description of an embodiment of the invention taken in conjunction with the accompanying drawings, wherein.

Figure 1:
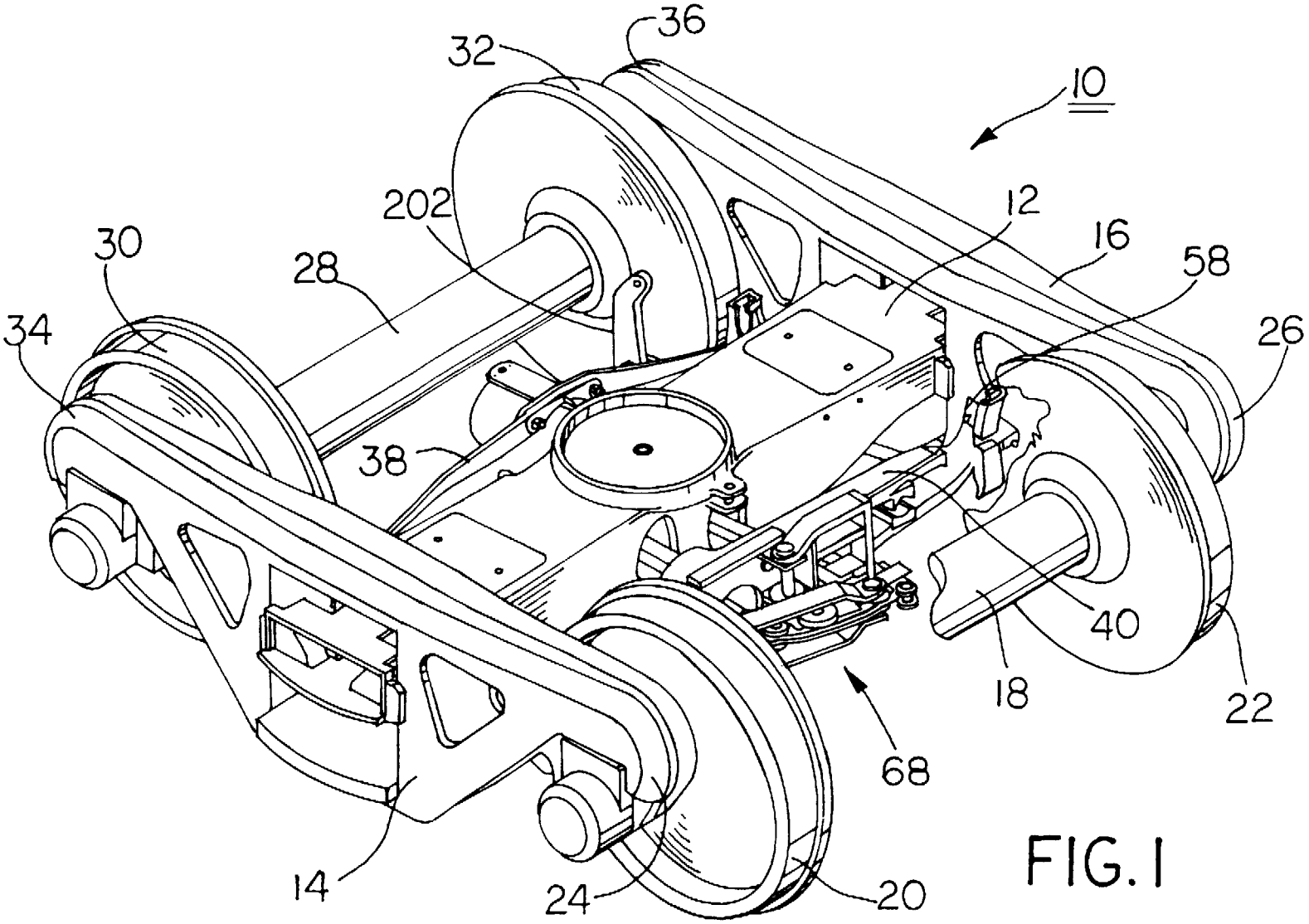
FIG. 1 is a perspective view of the braking mechanism of the present invention mounted to an assembled railroad car truck with a portion of the truck broken away to show details of the braking mechanism.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out below illustrates an embodiment of the invention, in one form, and such exemplification is not to be construed as limiting the scope of the invention in any manner.

DESCRIPTION OF THE INVENTION

The embodiment disclosed in the detailed description below is not intended to be exhaustive or to limit the invention to the precise form disclosed. Rather, the embodiment selected for the description is disclosed so that others skilled in the art may utilize its teachings.

Figure 2:
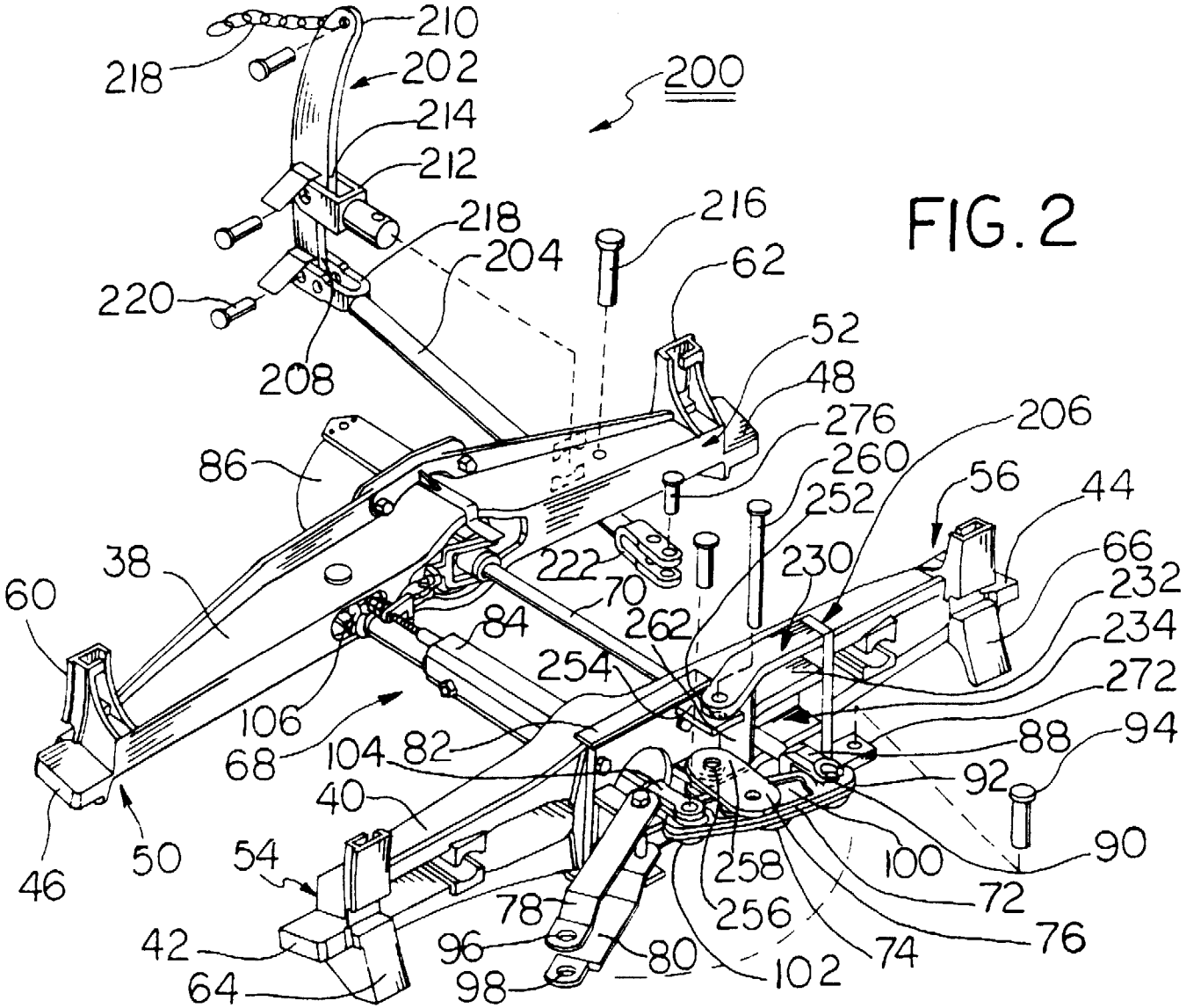
FIG. 2 is an exploded perspective view of the braking mechanism of the present invention.

Referring to the drawings, a truck assembly 10 is used, for example, to support railroad cars, and is well known to those skilled in the art. Truck assembly 10 is described below only to the extent required to ensure an understanding of the present invention. Referring now to FIGS. 1 and 2, truck assembly 10 includes bolster 12 which supports the load being carried (e.g., a railroad car). Bolster 12 extends perpendicularly between parallel sidewalls 14,16 to form the shape of an "H". Axle 18, carrying wheels 20,22, extends parallel to bolster 12 between opposed ends 24,26 of sidewalls 14,16 respectively. Another axle 28, carrying wheels 30,32 similarly extends between ends 34,36. Brake beams 38,40 also extend between sidewalls 14,16 parallel to bolster 12. Beams 38,40 have extensions 42,44,46,48 at ends 50,52, 54,56 respectively (shown in FIG. 2) which are suspended within pockets 58 (only one shown in FIG. 1) of sidewalls 14,16. Beam 38 carries brake pad 60 in substantial alignment with wheel 30 at end 50 and brake pad 62 in substantial alignment with wheel 32 at end 52. Similarly, beam 40 carries brake pad 64 in substantial alignment with wheel 20 at end 54 and brake pad 66 in substantial alignment with wheel 22 at end 56.

Linkage, generally designated 68, extends through bolster 12 and is attached to beams 38,40 as described in U.S. Pat. No. 5,259,485. As shown in FIG. 2, linkage 68 includes actuation rod 70, brake lever 72, force application levers 74,76, stabilizer bars 78,80, bracket 82, and slack adjuster 84. Actuation rod 70 extends from pneumatic actuator 86, or cylinder, centrally mounted to beam 38 and terminates with coupling device or clevis 88. Clevis 88 is aligned with bore 90 which extends through end 92 of brake lever 72. Stabilizer bars 78,80 extend from bracket 82 and are movably secured to clevis 88 and brake lever 72 with pin 94. When linkage 68 is assembled, pin 94 extends through openings 96,98 in stabilizer bars 78,80 respectively, which are aligned with bore 90 and clevis 88. Recessed portion 100 extends across brake lever 72. Force application levers 74,76 are pivotally connected between bracket 82, which is fixedly attached to beam 40, and brake lever 72 as shown in FIG. 2. End 102 of brake lever 72 is connected to clevis 104 of slack adjuster 84 in a manner similar to the connection between clevis 88 of actuating rod 70 and end 92. Opposed end 106 of slack adjuster 84 is connected to beam 38.

Figure 3:
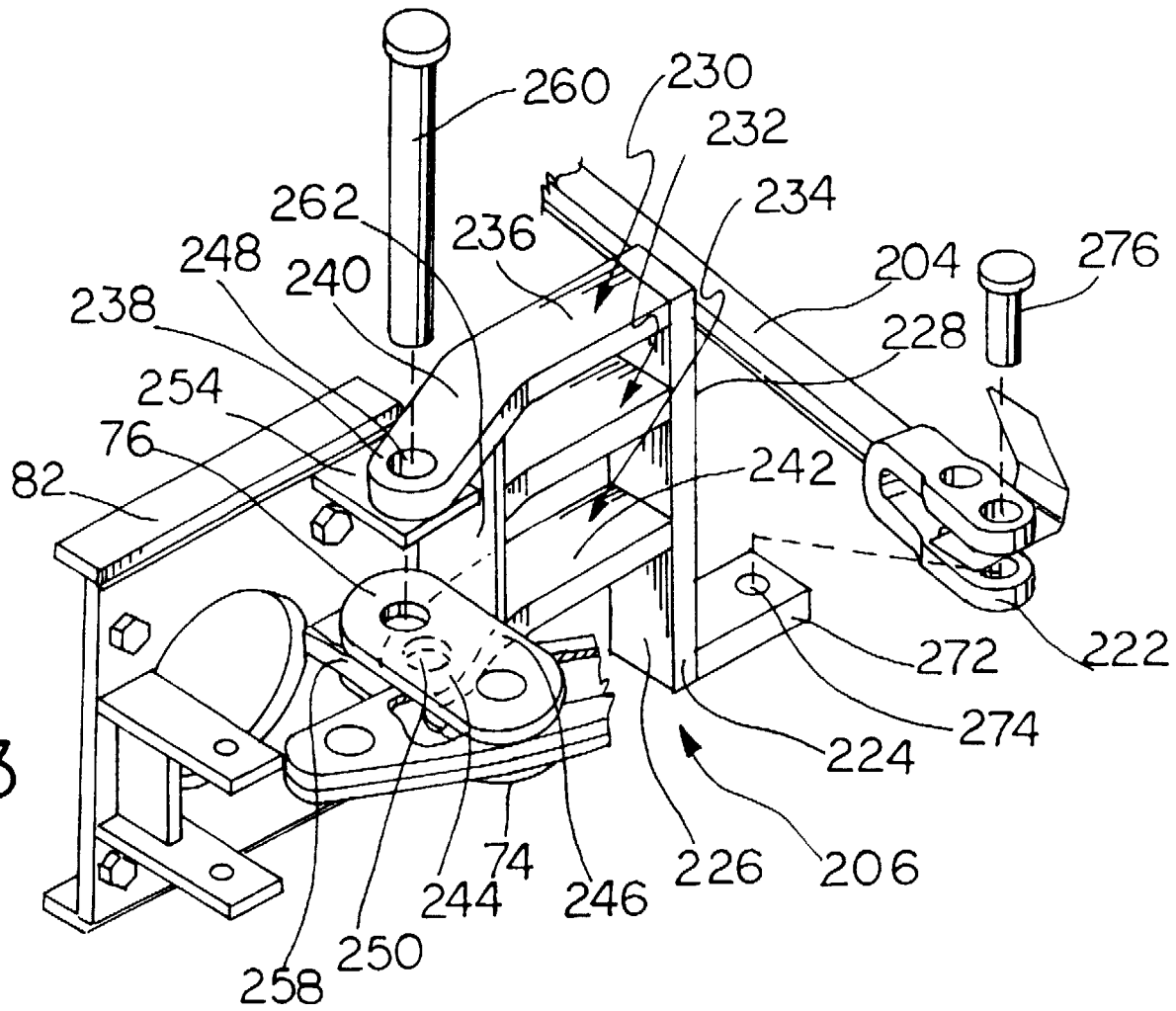
FIG. 3 is an exploded perspective view illustrating the interconnection between the linkage and the push rod and actuation lever of the present invention.

FIGS. 2 and 3 show braking mechanism 200 of the present invention including handle lever 202, push rod 204, and actuation lever 206. In the exemplary embodiment, handle lever 202 is an elongated flattened bar having ends 208 and 210 which are curved in a direction opposing the application of braking force to handle lever 202 as will be further explained below. Handle lever 202 is connected to brake beam 38 at a location offset from the center of beam 38 through clevis 212 as shown in FIG. 2. Clevis 212 is movably attached to handle lever 202 at fulcrum 214. The movable connection between clevis 212 and lever 202, like most of the movable connections described herein, can be accomplished using a variety of conventional fastening means including locking pin 216, a rod and cotter pin combination, a nut and bolt combination, and other means. The exemplary embodiment is described as using locking pins for most such movable connections. End 210 of handle lever 202 is attached to the brake application means which, in the exemplary embodiment, includes chain 218 connected to a geared handcrack (not shown) as is commonly employed in the art. End 208 of handle lever 202 is movably connected to vertical clevis end 218 of push rod 204 using locking pin 220.

Figure 5:
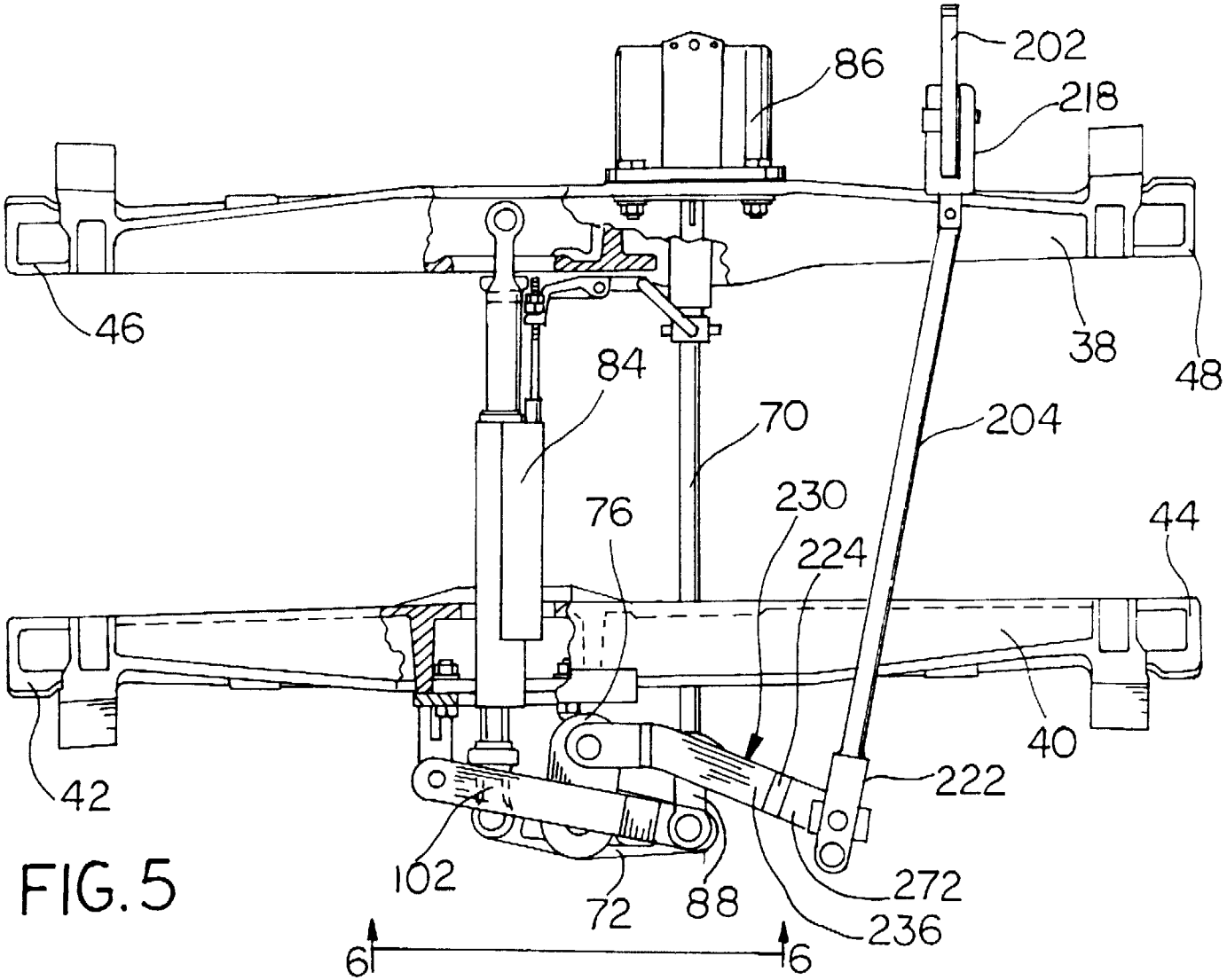
FIG. 5 is a top view of the braking mechanism of the present invention.

Push rod 204 extends diagonally between beams 38,40 from vertical clevis end 218 to horizontal clevis end 222 as is best shown in FIG. 5. Push rod 204 extends under beams 38,40 to avoid interference with bolster 12 when beams 38,40 are mounted to truck assembly 10 as will be described in further detail below. Referring now to FIG. 3, lever 206 includes vertical support 224 which has sides 226, 228. Upper arm 230, middle arm 232, and lower arm 234 extend from side 226 of vertical support 224 in substantially parallel, spaced relationship. Upper arm 230 includes segment 236 which is attached to vertical support 224 by welding or other suitable attachment means, and portion 238 which extends at an angle from the longitudinal axis of segment 236 defined by bend 240. Similarly, lower arm 234 includes segment 242 which is attached to vertical support 224, and portion 244 which diverges from the longitudinal axis of segment 242 according to bend 246. Upper arm 230 portion 238 defines bore 248. Lower arm 234 portion 244 defines bore 250. Bore 248 is aligned with opening 252 which extends through flange 254 of bracket 82. Bore 250 is similarly aligned with opening 256 which extends through flange 258. Lock pin 260 extends through bore 248, flange opening 252, bores 248,250 of force application levers 74,76, flange opening 256, and bore 250 to secure actuation lever 206 and application levers 74, 76 to bracket 82.

Figure 6:
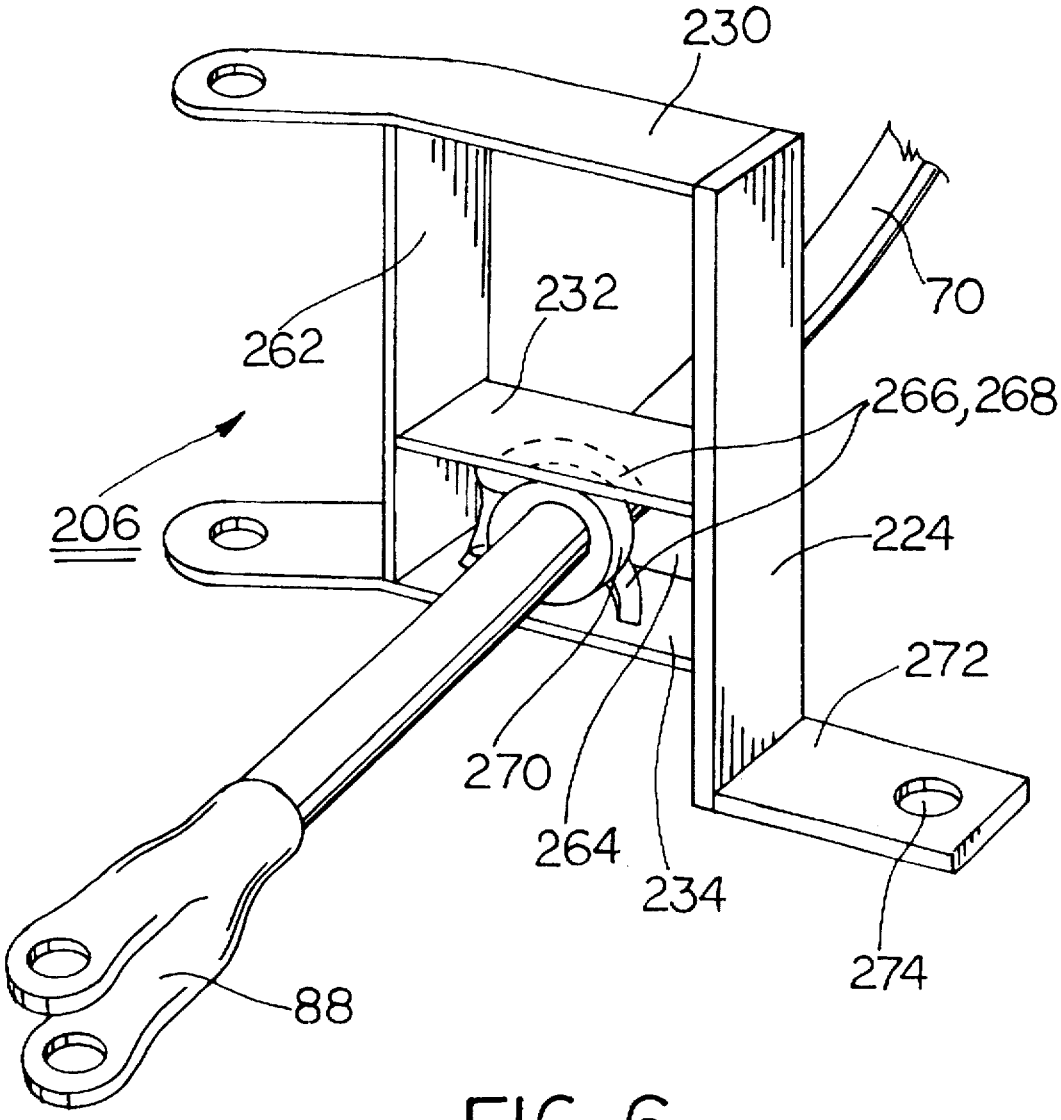
FIG. 6 is a perspective view of the actuation lever of the present invention.

Lever 206 also includes brace 262 which extends between upper arm 230 and lower arm 234. Middle arm 232 is also connected to brace 262, and cooperates with vertical support 224, lower arm 234, and brace 262, to form substantially rectangular opening 264. As shown in FIG. 6, opposed ridges 266,268 extend into opening 264 from middle arm 232 and lower arm 234 respectively. Actuation rod 70 of linkage 68 extends through opening 264 between ridges 266,268. Ridges 266,268 cooperate to form a curved coupling to conform to the shape of ring 270 which extends circumferentially from actuating rod 70 near clevis 88. Finally, push arm 272 extends perpendicularly from the lowermost end of vertical support 224 along a longitudinal axis which is substantially aligned with the longitudinal axes of upper arm 230, middle arm 232, and lower arm 234. As shown in FIG. 5, push arm 272 extends from vertical support 224 in a direction opposing the extension of segments 236,242 and middle arm 232. Push arm 272 defines bore 274 for accepting pin 276 to movably secure horizontal clevis 222 of push rod 204 to push arm 272.

MODE OF OPERATION

In operation, when the train's pneumatic system is enabled, brake beams 38,40 are pneumatically actuated by linkage 68 driven by cylinder 86. The operator actuates cylinder 86 which forces actuation rod 70 away from beam 38. As a result, clevis 88 pushes against end 92 of brake lever 72 which causes brake lever 72 to pivot about pin 260. As brake lever 72 pivots, end 102 forces clevis 104 of slack adjuster 84 toward beam 38. Thus, slack adjuster 84 translates part of the force generated by cylinder 86 back to beam 38. The end result of this brake force application method, as more fully described in U.S. Pat. No. 5,259,485, is that beams 38,40 maintain a substantially parallel relationship as linkage 68 forces beams 38,40 away from one another because of the centrally-applied braking force transmitted by the slack adjuster 84. Thus, beam extensions 42,44,46,48 travel within pockets 58 along paths which remain substantially parallel with sidewalls 14,16 as beams 38,40 move into a braking position. Consequently, brake pads 60,62,64,66 contact wheels 30,32,20,22 at approximately the same time with substantially equal braking force.

When air pressure is removed from cylinder 86, slack adjuster 84, which is biased to elongate, extends, causing brake lever 72 to pivot so that actuation rod 70 moves, without resistance from air cylinder 86, toward cylinder 86. Brake beams 38,40 thus move toward one another while maintaining a parallel relationship, simultaneously disengaging brake pads 60,62,64,66 from wheels 30,32,20,22 respectively, until beams 38,40 come to rest in a standby position.

Figure 4:
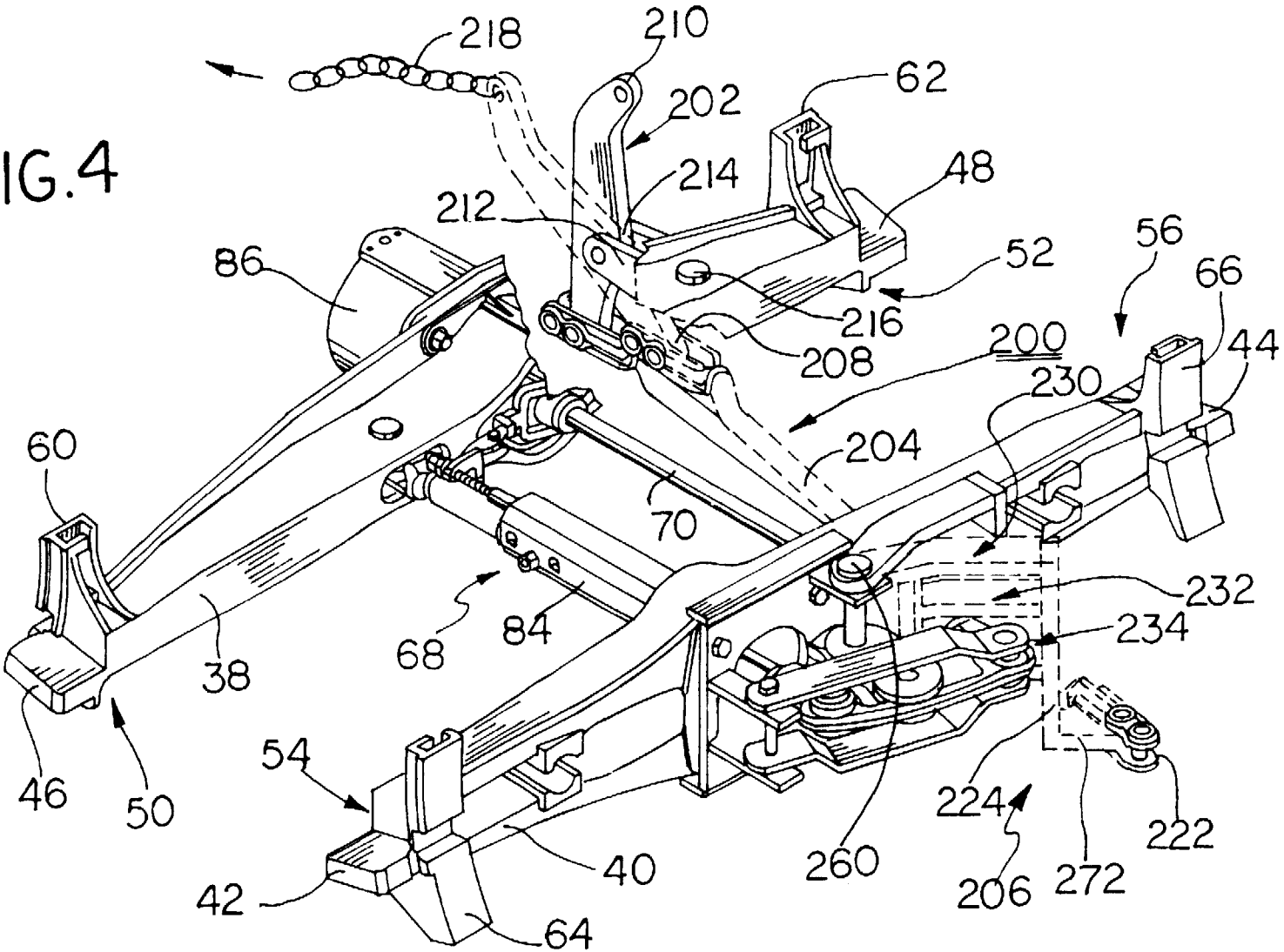
FIG. 4 is a perspective view of the braking mechanism of the present invention with a portion broken away to illustrate the braking mechanism in both a braking position and a stand-by position.

Braking mechanism 200 of the present invention operates linkage 68 to achieve a similar application of braking force without pneumatics. FIG. 4 illustrates braking mechanism 200 in a standby position (shown in solid lines) and a braking position (shown in dashed lines). When the air supply to the car is disconnected, for example, during loading and unloading, air cylinder 86 cannot brake the car. Thus, in the exemplary embodiment, the operator applies the brakes manually by turning a geared wheel crank (not shown) which pulls chain 218 longitudinally away from handle lever 202. End 210 of handle 202 pivots about fulcrum 214 of handle 202 into a braking position as illustrated by the dashed lines of FIG. 4. Accordingly, end 208 of handle 202 forces push arm 204 toward beam 40. Since clevis 212 is mounted on beam 38 at a location closer to pad 62 than pad 60, a larger component of the force applied through chain 218 to handle 202 translates to pad 62 at end 52 than translates to pad 60 at end 50.

The remaining braking force is imparted through push rod 204 to push arm 272 of actuation lever 206. As push rod 204 moves toward beam 40 in response to handle 202, horizontal clevis 222 urges push arm 272 to rotate outwardly from beam 40 about pin 260. When lever 206 begins to rotate about pin 260, middle arm 232 and lower arm 234 carry ridges 266,268 respectively away from beam 40 into contact with ring 270 of actuation rod 70. By engaging ring 270, ridges 266,268 enable lever 206 to move actuation rod 70 away from cylinder 86 in a manner similar to the motion imparted to actuation rod 70 by cylinder 86 during pneumatic braking. Again, as occurs during pneumatic braking, actuation rod 204 causes brake lever 72 to pivot such that clevis 104 forces slack adjuster 84 toward brake beam 38. Braking force is transferred to beam 40 near the center of beam 40 through force application levers 74,76. Beam 40 moves toward wheels 20,22 as extensions 42,44 slide within pockets 58. Ultimately, when beam 40 reaches a braking position, brake pads 64,66 contact wheels 20,22 respectively.

Simultaneously, additional braking force is transferred to brake beam 38 at a point offset from the center of beam 38 where end 106 of slack adjuster 84 is attached to beam 38. This additional force combines with the force initially translated to end 52 of beam 38 by chain 218. As beam 38 moves toward wheels 30,32, extensions 46,48 follow a path within pockets 58 which is substantially parallel to sidewalls 14,16. Eventually, beam 38 reaches a braking position when brake pads 60,62 contact wheels 30,32 respectively. Accordingly, when the operator manually actuates handle 202, actuation lever 206 operates linkage 68, normally used during pneumatic braking, so that all four brake pads 60,62, 64,66 contact truck wheels 30,32,20,22 at substantially the same time with substantially the same braking force.

While this invention has been described as having an exemplary embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

We claim:

1. Braking mechanism for braking the wheels of a railroad car, said braking mechanism comprising:

a pair of opposed brake beams disposed adjacent the wheels movable between a standby position and a braking position, each of said beams carrying brake pads for contacting the wheels when said beams are in said braking position;

linkage means connected between said beams for moving said beams between said standby position and said braking position, said linkage means including a pivot pivotally connecting the linkage means to one of said brake beams;

a pneumatic actuator mounted on the other brake beam for operating said linkage means including an actuation rod connected to said linkage means for operating the latter; and a mechanical actuator including an arm mounted on said other brake beam, a member connecting said arm to said linkage means, and coupling means for coupling said member to said linkage means when said mechanical actuator is used to move said beams to said braking position, said coupling means permitting said pneumatic actuator to operate said linkage means when said pneumatic actuator is used to move said beams to said braking position.

2. Mechanism of claim 1 wherein said coupling means includes a lever movably connected to said one beam, said lever carrying said coupling means.

3. Mechanism of claim 2 wherein said lever includes a vertical support member having an upper arm, a lower arm, and a middle arm extending in one direction therefrom in substantially parallel, spaced relationship, and a push arm projecting in an opposite direction, said upper and lower arms being pivotally connected to said linkage means, said middle and lower arms including said coupling means.

4. Mechanism of claim 3 wherein said coupling means includes two opposed engagement ridges with a gap therebetween for receiving said actuation rod, one said ridge projecting from said middle arm toward said actuation rod, the other said ridge projecting from said lower arm toward said actuation rod, whereby as said beams are moved to said braking position, said engagement ridges mate with said actuation rod, shifting said actuation rod along its longitudinal axis thereby operating said linkage means.

5. Mechanism of claim 2 wherein said member includes a push rod connected to said lever for operating said lever.

6. Mechanism of claim 5 wherein said coupling means couples said push rod to said actuator rod when the mechanical actuator is used but releases to permit said pneumatic actuator to move said brake beams.

7. Mechanism of claim 5 wherein said arm is an elongated bar having one end pivotally attached to said push rod and another end connected to means for applying braking force, said bar having a pivot point adjacent said one end connected to said other beam thereby defining a lever arm between said pivot point and said other end providing mechanical advantage to said one end in moving said push rod.

8. Mechanism of claim 2 wherein said linkage means is substantially centrally disposed relative to the ends of said beams, said lever extends laterally from said linkage means, said arm is connected adjacent an end of said one beam at a point laterally offset from said lever, and said push rod has a bend to accommodate the offset relationship between said lever and said handle means.

9. Braking mechanism for braking the wheels of a railroad car, said braking mechanism comprising:

opposed brake beams disposed adjacent the wheels movable between a standby position and a braking position, each of said beams having ends carrying brake pads for contacting the wheels when said beams are in said braking position;

a linkage pivotally connected to one of said beams, said linkage including a pneumatic actuator mounted on the other beam and having an actuation rod for operating said linkage by applying a braking force causing said linkage to move said beams away from one another from said standby position to said braking position; and a mechanical actuator mounted on said other beam and acting through said actuation rod for operating said linkage, said mechanical actuator having a coupling drivingly connecting said mechanical actuator to said actuation rod to operate said linkage when said mechanical actuator is used to move said beams to said braking position, said coupling releasing to permit said pneumatic actuator to operate said actuation rod when said pneumatic actuator is used to move said beams to said braking position.

10. Mechanism of claim 9 wherein said mechanical actuator includes a lever having spaced arms movably connected to said linkage, said arms carrying said coupling.

11. Mechanism of claim 10 wherein said coupling includes two opposed ridges disposed between two of said spaced arms, said ridges adapted to mate with said actuation rod when said mechanical actuator is used to operate said linkage.

12. Mechanism of claim 10 wherein said mechanical actuator includes an arm pivotally mounted on said other brake beam, a push rod connecting said arm to said lever whereby said braking force is communicated through said push rod to said lever when said mechanical actuator is used to operate said linkage.

* * * * *